US011359455B2

(12) United States Patent
Ruckert et al.

(10) Patent No.: US 11,359,455 B2
(45) Date of Patent: Jun. 14, 2022

(54) METHOD OF PREPARING A WELLBORE TUBULAR COMPRISING AN ELASTOMER SLEEVE

(71) Applicant: SHELL OIL COMPANY, Houston, TX (US)

(72) Inventors: Frank Ruckert, Rijswijk (NL); Walter Stam, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/251,319

(22) PCT Filed: Jun. 7, 2019

(86) PCT No.: PCT/EP2019/064974

§ 371 (c)(1),
(2) Date: Dec. 11, 2020

(87) PCT Pub. No.: WO2019/238566

PCT Pub. Date: Dec. 19, 2019

(65) Prior Publication Data

US 2021/0254429 A1 Aug. 19, 2021

(30) Foreign Application Priority Data

Jun. 13, 2018 (EP) ..... 18177509

(51) Int. Cl.
*E21B 33/14* (2006.01)
*E21B 17/10* (2006.01)

(52) U.S. Cl.
CPC ..... *E21B 33/14* (2013.01); *E21B 17/1042* (2013.01)

(58) Field of Classification Search
CPC ..... E21B 33/14; E21B 17/1042
(Continued)

(56) References Cited

U.S. PATENT DOCUMENTS 4,434,076 A 2/1984 Mardis et al.
4,716,965 A 1/1988 Bol et al.
(Continued)

FOREIGN PATENT DOCUMENTS

WO 02059452 A1 8/2002
WO 2005093202 A1 10/2005
(Continued)

OTHER PUBLICATIONS

International Search Report and Written Opinion received for PCT Patent Application No. PCT/EP2019/064974, dated Nov. 7, 2019, 16 pages.

(Continued)

*Primary Examiner* — Crystal J. Lee
*Assistant Examiner* — Ashish K Varma
(74) *Attorney, Agent, or Firm* — Shell USA, Inc.

(57) ABSTRACT

An elastomer sleeve is applied to a wellbore tubular. The elastomer sleeve, which defines a circumference around longitudinal bore in a longitudinal direction, is brought in an elastically stretched condition by applying a stretching force to the elastomer sleeve. While the elastomer sleeve is kept in the elastically stretched condition, it is moved in the longitudinal direction over the wellbore tubular to a selected position on the wellbore tubular whereby the wellbore tubular extends through the bore. The elastomer sleeve is then snuggly fitted to an outside surface of the wellbore tubular by relaxing the elastically stretching force. The thus prepared wellbore tubular may be lowered into a wellbore in the Earth, and cement may be pumped on the outside of the wellbore tubular to form a cement sheath which fully surrounds the elastomer sleeve.

10 Claims, 6 Drawing Sheets

(58) Field of Classification Search
USPC ..... 166/285
See application file for complete search history.

(56) References Cited

U.S. PATENT DOCUMENTS

| | | | | |
|---|---|---|---|---|
| 6,848,505 | B2 | 2/2005 | Richard et al. | |
| 7,527,099 | B2 | 5/2009 | Bosma et al. | |
| RE41,118 | E * | 2/2010 | Brezinski | E21B 33/12 166/387 |
| 8,540,032 | B2 | 9/2013 | Nutley et al. | |
| 8,726,992 | B2 | 5/2014 | Freyer | |
| 9,796,877 | B2 | 10/2017 | Cornelissen et al. | |
| 2004/0055758 | A1 | 3/2004 | Brezinski et al. | |
| 2006/0000617 | A1 | 1/2006 | Harrall et al. | |
| 2007/0163777 | A1* | 7/2007 | Murray | E21B 33/1208 166/179 |
| 2008/0017387 | A1 | 1/2008 | Green et al. | |
| 2008/0135260 | A1* | 6/2008 | Berzin | E21B 33/1208 166/380 |
| 2009/0146381 | A1* | 6/2009 | Herrera | E21B 33/14 277/336 |
| 2010/0163252 | A1* | 7/2010 | Regnault De La Mothe | C09K 8/422 166/387 |
| 2011/0297400 | A1 | 12/2011 | Pessin et al. | |
| 2012/0312560 | A1 | 12/2012 | Bahr et al. | |
| 2013/0037267 | A1 | 2/2013 | Regnault De La Mothe | |
| 2014/0048252 | A1 | 2/2014 | King et al. | |

FOREIGN PATENT DOCUMENTS

| | | | |
|---|---|---|---|
| WO | 2005121498 | A1 | 12/2005 |
| WO | 2007150022 | A2 | 12/2007 |
| WO | 2007150040 | A1 | 12/2007 |
| WO | 2009024553 | A1 | 2/2009 |
| WO | 2014137314 | A1 | 9/2014 |
| WO | 2018060117 | A1 | 4/2018 |

OTHER PUBLICATIONS

Brooks et al., "Use of Swellable Elastomers to Enhance Cementation in Deep Water Applications", Deep Offshore Technology International : 2008 Conference proceedings : Feb. 12-14, 2008, 13 Pages.
"Swell Right Sleeve", Swellable Sleeve System for Zonal Isolation, Tendeka, 1 Page.
EcoPROTECT, Coating Composition, Commercially Available from EcoLINE Coatings B.V, 2 Pages.
Micro-Seal™ Isolation System-Unit(MSIS-U), Swellable Well Construction Products, 2 Pages.
Instructions for use EcoPROTECT Barrier Coating, 2 Pages.

* cited by examiner

METHOD OF PREPARING A WELLBORE TUBULAR COMPRISING AN ELASTOMER SLEEVE

CROSS REFERENCE TO RELATED APPLICATIONS

This is a US national stage application of International application No. PCT/EP2019/064974, filed Jun. 7, 2019, which claims benefit of priority of European application No. 18177509.9, filed Jun. 13, 2018. Both applications are incorporated herein by reference.

FIELD OF THE INVENTION

In one aspect, the present invention relates to a method of preparing a wellbore tubular comprising an elastomer sleeve. The wellbore tubular may be installed in a wellbore in the Earth. In other aspects, the present invention relates to wellbore tubular comprising an elastic sleeve and a wellbore in the Earth provided with such a wellbore tubular.

BACKGROUND OF THE INVENTION

In the oil and gas industry, wellbore tubulars are commonly cemented into a wellbore in the Earth. This means that an annular layer of cement (a cement sheath) is brought in place around the wellbore tubular. One purpose of such cement is to avoid wellbore fluids from reaching the surface of the Earth via flow paths on the outside of the wellbore tubular. Even if cement has been placed properly, it is not uncommon that a failure of the cement sheath occurs.

In a paper prepared for presentation at the Deep Offshore Technology Conference in Houston (12-14 Feb. 2008) entitled "Use of Swellable Elastomers to Enhance Cementation in Deep Water Applications" by Bob Brooks et al, a remedy is proposed in providing a layer of elastomer between casing and the cement. This can reduce strain loading of the cement sheath and/or seal off micro-annuli which may form when the bond at the casing/cement interface is lost. A swellable packer has the ability to swell and seal off the microannulus.

The aforementioned paper does not disclose how the swellable elastomer is applied to the casing. Usually, swellable packers and sleeves are clamped to the casing, such as in the case of SwellRight Sleeve. SwellRight Sleeve is a swellable slide-on sleeve system for zonal isolation, marketed by Tendeka. The sleeves are made of an oil, water or hybrid swelling elastomer, and are mechanically grub screwed on to the base pipe.

SUMMARY OF THE INVENTION

The invention provides a method of preparing a wellbore tubular comprising an elastomer sleeve, the method comprising steps of:

providing a wellbore tubular;

providing an elastomer sleeve defining a circumference around a longitudinal bore in a longitudinal direction;

bringing the elastomer sleeve in an elastically stretched condition, by applying a stretching force to the elastomer sleeve, whereby elastically stretching the elastomer sleeve in a circumferential direction;

while the elastomer sleeve is kept in the elastically stretched condition, moving the elastomer sleeve in the longitudinal direction over the wellbore tubular, to a selected position on the wellbore tubular whereby the wellbore tubular extends through the bore; and subsequently:

snugly fitting the elastomer sleeve to an outside surface of the wellbore tubular by relaxing the elastically stretching force.

In one aspect of the invention, the wellbore tubular prepared this way may be installed in a wellbore in the Earth, comprising steps of lowering the wellbore tubular into a wellbore in the Earth at a wellsite and pumping cement on the outside of the wellbore tubular whereby fully surrounding the elastomer sleeve.

In another aspect, the invention provides a wellbore tubular comprising an elastomer sleeve snugly fitting to an outside surface of the wellbore tubular without the aid of a clamping ring and/or adhesive material. The elastomer sleeve itself is suitably under circumferential elastic tension. A cement sheath may be provided on the outside of the wellbore tubular, which fully surrounds the elastomer sleeve.

In still another aspect, the invention provides wellbore in the Earth provided with such a wellbore tubular, in which case the cement sheath may fill up an annular space in the wellbore surrounding the wellbore tubular.

BRIEF DESCRIPTION OF THE DRAWING

The appended drawing, which is non-limiting, comprises the following figures.

DETAILED DESCRIPTION OF THE INVENTION

The invention will be further illustrated hereinafter by way of example only, and with reference to the non-limiting drawing. The person skilled in the art will readily understand that, while the invention is illustrated making reference to one or more specific combinations of features and measures, many of those features and measures are functionally independent from other features and measures such that they can be equally or similarly applied independently in other embodiments or combinations.

An elastomer sleeve is brought in an elastically stretched condition in its circumferential direction, thereby enlarging its longitudinal bore to a larger diameter compared to the sleeve in neutral un-stretched condition, and kept in the elastically stretched condition as it is moved onto the wellbore tubular. Once the elastomer sleeve is in a selected position on the wellbore tubular whereby the wellbore tubular extends through the bore, the elastically stretching force is relaxed after which the elastomer sleeve snugly fits on the an outside surface of the wellbore tubular. There may still be some residual strain left in the elastomer sleeve to hold the elastomer sleeve tightly in place on the wellbore tubular without the need for clamping.

The term wellbore tubular can mean any type of tubing that is designed for or intended to be run (lowered) into a wellbore in the Earth. It is envisaged that the present invention is primarily suited to be applied to wellbore tubulars that will be cemented into place, such as casing or production liners.

As stated above, Tendeka markets swellable sleeves for zonal isolation, under the name SwellRight. SwellRight sleeves are low profile, slide-on sleeves which are mechanically grub screwed on to the base pipe. The sleeves are made of an oil, water or hybrid swelling elastomer. The presently proposed method of preparing the wellbore tubular with the elastomer sleeve does not require grub screwing the elastomer sleeve to the wellbore tubular.

The method of preparing a wellbore tubular is graphically illustrated in FIG. 1 which consists of parts A to F.

Figure 1A:
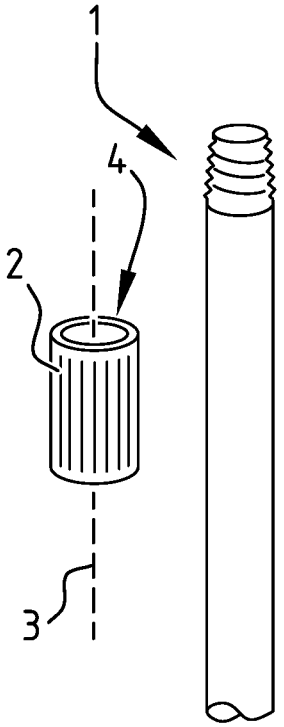
FIGS. 1A to 1F schematically show perspective views illustrating an example sequence of steps of preparing a wellbore tubular.

FIG. 1A shows a wellbore tubular 1 and an elastomer sleeve 2. The elastomer sleeve defines a cylindrical circumference around a longitudinal central axis 3. A longitudinal bore 4 is enclosed by the elastomer sleeve 2. Initially the longitudinal bore 4 has an inner diameter that is at most equal to, but preferably smaller than, the outer diameter of the wellbore tubular at a selected location which corresponds to the target location where the elastomer sleeve 2 is intended to be fit on the wellbore tubular 1.

Figure 1B:
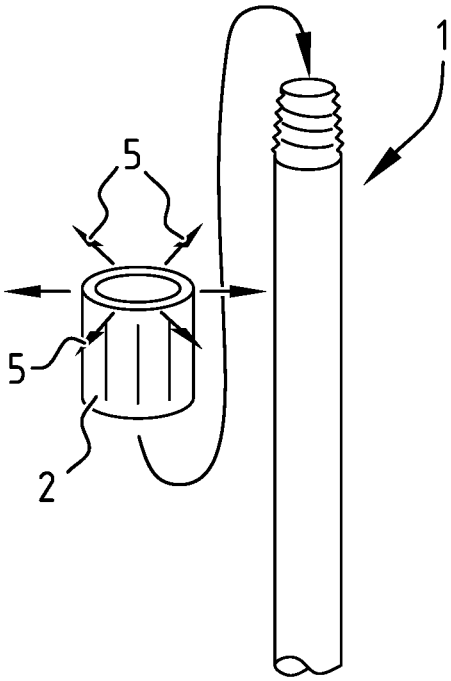

FIG. 1B shows the wellbore tubular 1 and the elastomer sleeve 2 of FIG. 1A. The elastomer sleeve 2 has been brought in an elastically stretched condition. Radially outwardly directed stretching forces 5 are applied on the elastomer sleeve, whereby the elastomer is elastically stretched into tension in the circumferential direction.

Figure 1C:
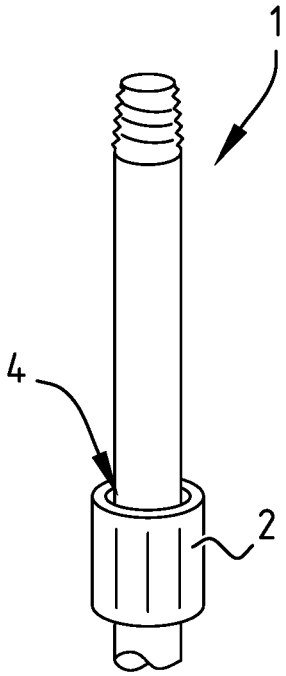

While the elastomer sleeve 2 is kept in the elastically stretched condition, it is moved in the longitudinal direction over the wellbore tubular 1 to a selected position. FIG. 1C shows the elastically stretched elastomer sleeve 2 at its selected position on the wellbore tubular 2. The wellbore tubular 1 extends through the longitudinal bore 4 of the elastomer sleeve 2.

Figure 1D:
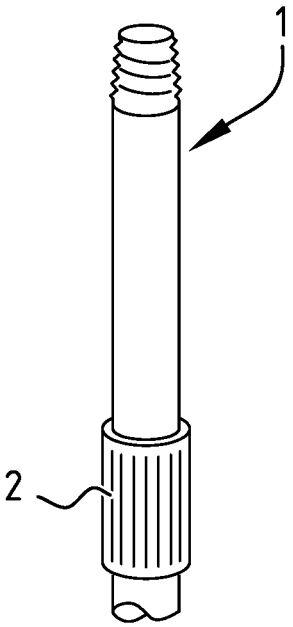
Figure 1E:
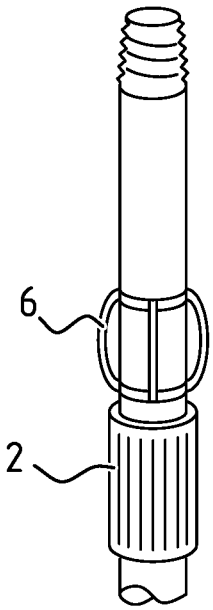
Figure 1F:
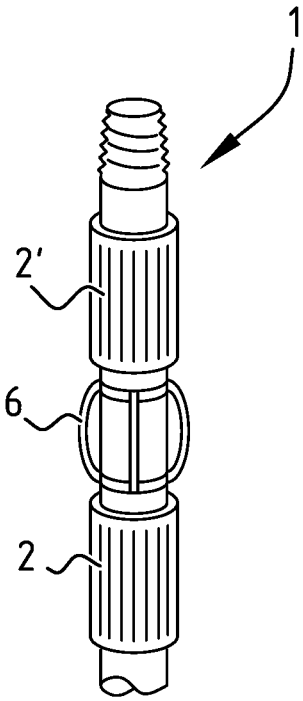

With the elastomer sleeve 2 in the selected position, elastically stretching force is relaxed. FIG. 1D shows the elastomer sleeve 2 snugly fitting to an outside surface of the wellbore tubular 1. Suitably some residual elastic strain is still present in the elastomer sleeve 2 when it is in snug contact with the wellbore tubular 1. This will help to keep the elastomer sleeve 2 in position without the need for external additional clamping.

The elastomer sleeve 2 snugly fits onto the outside surface of the wellbore tubular 1 without the aid of any additional mechanical clamping ring. The elastomer sleeve 2 may already stay in place by virtue of frictional force if the elastomer sleeve is in elastically neutral condition whereby the inside diameter of the longitudinal bore 4 is exactly identical to the outside diameter of the wellbore tubular 1. Residual circumferential tension in the elastomer sleeve further enhances the frictional force. This may be sufficient to keep the elastomer sleeve 2 in place sufficiently long before cementing.

Notwithstanding, an additional bonding agent may optionally be applied between the elastomer sleeve 1 and the outside surface of the wellbore tubular 2. A bonding agent may for example include an adhesive layer. Such adhesive layer may for example be applied to the wellbore tubular 2 in direct proximity to the selected location, using for example a brush, a roller or a spray gun. Alternatively, the bonding agent may be provided on the inside surface of the elastomer sleeve which faces towards the longitudinal bore 4.

Once the elastomer sleeve 2 has been fitted to the wellbore tubular 1, a mechanical spacer 6 may be mounted on the wellbore tubular 1, longitudinally adjacent to the elastomer sleeve 2. The mechanical spacer 6 may for example comprise a ring or a collar or a centralizer. The mechanical spacer 6 may extend further outward in radial direction from the longitudinal bore than the elastomer sleeve 2 prior to and/or during running into a wellbore. Herewith the elastomer sleeve 2 is protected from mechanical impact and wear and tear which can otherwise occur for example when running the wellbore tubular 1 in a borehole. The mechanical spacer 6 may be bolted or clamped onto the wellbore tubular 1 or held in place in any other suitable manner.

The procedure can be repeated by fitting one or more additional elastomer sleeves 2' onto the same wellbore tubular 1. Additional mechanical spacers (not shown) may also be mounted.

Figure 2:
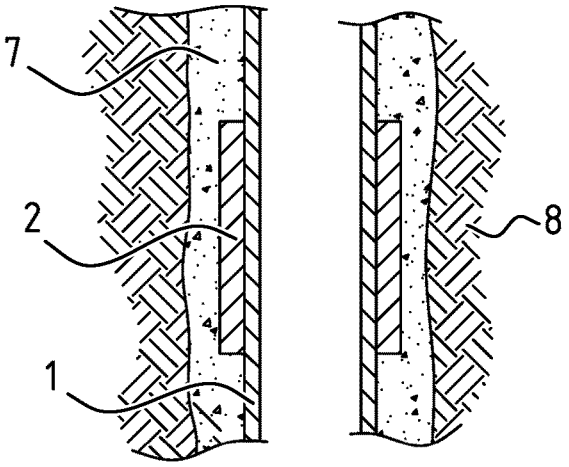
FIG. 2 schematically shows a cross sectional view of a wellbore tubular prepared in accordance with an embodiment of the invention cemented in a wellbore in the Earth.

FIG. 2 shows in cross section a section of the wellbore tubular 1 after it has been run into a wellbore in the Earth 8. Subsequently to lowering the wellbore tubular 1 into the wellbore, a cement sheath 7 has been created around the wellbore tubular. The cement sheath 7 fully surrounds the elastomer sleeve 2. A cement sheath 7 is commonly manufactured by pumping cement into an annulus on the outside of the wellbore tubular 1. The cement sheath 7 is typically an annular layer of cement around the wellbore tubular.

Suitably, the elastomer sleeve 2 is formed of a swellable elastomer, so that it swells upon contact with a wellbore fluid, such as a hydrocarbon fluid (oil or gas) or water (typically brine). Oil, water or hybrid swelling elastomers are known in the field. Non-limiting examples are provided in U.S. Pat. No. 7,527,099, which is incorporated herein by reference.

A swell preventive coating layer may be applied on an outside surface of the elastomer sleeve 2. Such a layer can suitably be applied subsequent to snugly fitting said elastomer sleeve 2 to the wellbore tubular 1. This will provide more time to run the wellbore tubular 1 into the wellbore in the Earth 8, and completing the cementing job prior to swelling of the elastomer sleeve 2. The coating layer delays the elastomer from being exposed to wellbore fluids which would cause the elastomer to swell prematurely, such as could otherwise happen when running in through a water-based mud. Amongst multiple options, a 2-component epoxy barrier coating layer has found to be a particularly suited composition. Such coating composition, commercially available from EcoLINE coatings B.V. (located in Reeuwijk, The Netherlands) under the name ecoPROTECT, may be applied safely without dilution, using a for example a brush, a mohair paint roller or a spray gun.

The elastomer sleeve may be brought into the elastically stretched condition by placing the elastomer sleeve longitudinally inside an outer tube and reducing a pressure in an annular space between the elastomer sleeve and the outer tube. Relaxing the elastically stretching force may be accomplished by restoring said pressure. A useful elastomer sleeve mounting tool 10 has been developed, which will be explained with reference to FIGS. 3A-E.

Figure 3A:
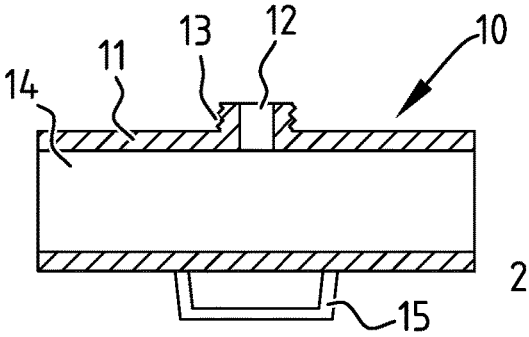
FIGS. 3A to 3E schematically show in cross sectional views a sequence of steps of preparing the wellbore tubular with aide of an elastomer sleeve mounting tool.

FIG. 3A shows the tool in cross sectional view. The tool 10 comprises an outer tube 11, which may essentially be a cylindrical body around a longitudinal bore 14. The side wall of the outer tube 11 is provided with a fluid communication port 12. Suitably a flange or a thread 13 or some other connection means is available on the communication port 12 in order to establish a fluid connection with a low pressure zone, such as a vacuum pump. A valve may be provided in a fluid conduit line between the communication port 12 and the low pressure zone. Optionally, a handle 15 may be provided on the outside of the outer tube 11.

The outer tube 11 may be made of any solid material, including for example metals. However, acrylic glass (polymethylmethacrylate, PMMA), has been found quite suitable and useful for the purpose, as it provides a way to visually monitor the elastomer inside the outer tube, which is helpful. Also, acrylic glass is relatively light, so easy to handle by hand.

Figure 3B:
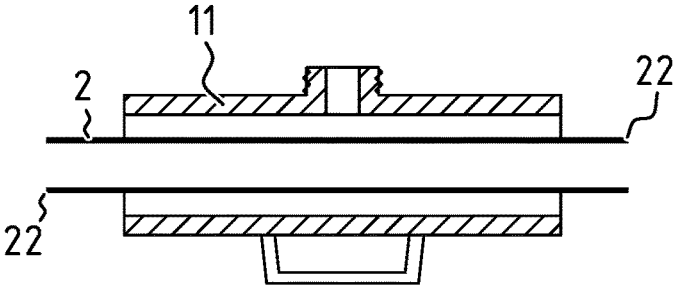
Figure 3C:
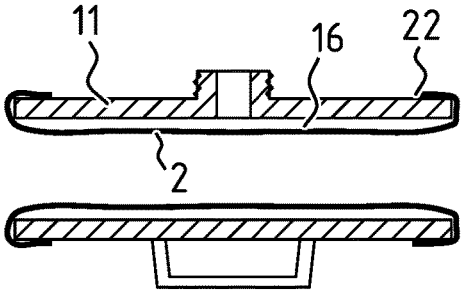

The elastomer sleeve 2 is placed longitudinally inside the outer tube 11 as shown in FIG. 3B. At this point, it is in elastically neutral condition comparable to the condition as illustrated in FIG. 1A. The ends 22 of the elastomer sleeve 2 can then be folded back (everted) over the outer tube 11. This is illustrated in FIG. 3C. Due to the elastic properties of the elastomer sleeve 2, an air-tight seal is now formed between the elastomer sleeve 2 and the outer tube at the ends of the outer tube 11, leaving an enclosed annular space 16 between the elastomer sleeve 2 and the inside of the outer tube 11. The communication port 12 provides access to this annular space 16. It may be possible to establish adequate seals between the elastomer sleeve 2 and the outer tube 11 in alternative manners, but the manner as described is suitable and fast.

Figure 3D:
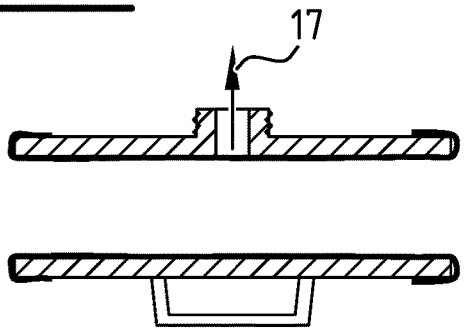

Subsequently the pressure in an annular space 16 between the elastomer sleeve 2 and the outer tube 11 is reduced, by exposing the annular space 16 to the low pressure zone. Arrow 17 in FIG. 3D schematically indicates the air being evacuated from the annular space 16. The elastomer sleeve 2 is thereby sucked to the outer tube 11 and thus brought into the tensile strained condition as shown in FIG. 1B.

Figure 3E:
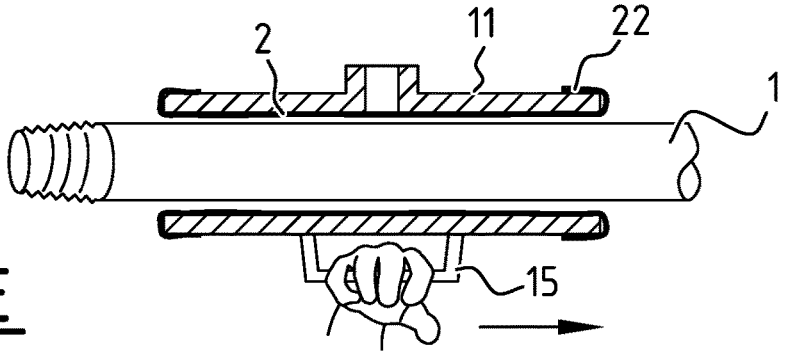

Next, the tool 10 with the elastomer sleeve 2 can be moved longitudinally over the wellbore tubular 1 to the selected location. This can easily be done by hand as illustrated in FIG. 3E. Nonetheless, a robot may be employed instead. With the elastomer sleeve 2 in the selected location, the pressure inside the annular space 16 can be restored and the ends of the elastomer sleeve 2 can be rolled off the outer tube 11 onto the wellbore tubular 1 to complete the installation of the elastomer sleeve 2 onto the wellbore tubular 1.

The elastomer sleeve mounting tool described hereinabove has been found to be quite useful, reliable and fast. Nonetheless, other methods may be applied to bring the elastomer sleeve 2 in the elastically stretched condition as needed. The stretching force may for example be applied by forcing a slick tube inside the longitudinal bore 4 of the elastomer sleeve 2, whereby the elastomer sleeve 2 is stretched. Or the elastomer sleeve 2 is everted in place over the wellbore tube 1 or the slick tube.

Figure 4D:
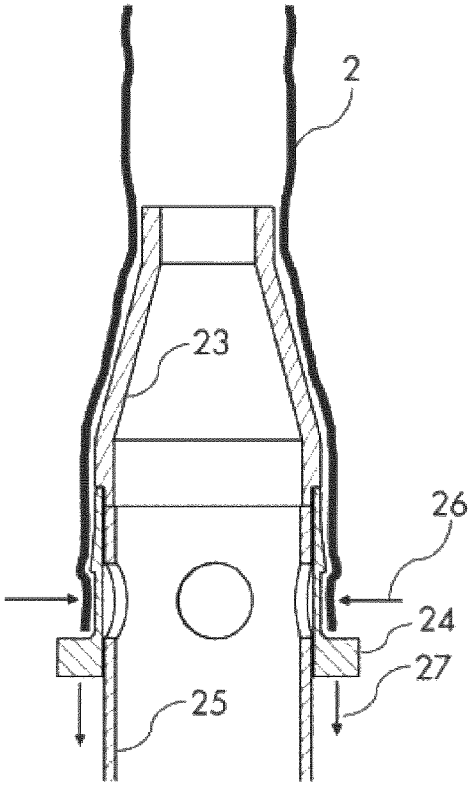
FIGS. 4A to 4J schematically illustrate cross sectional views of an alternative sequence of steps of preparing the wellbore tubular.
Figure 4C:
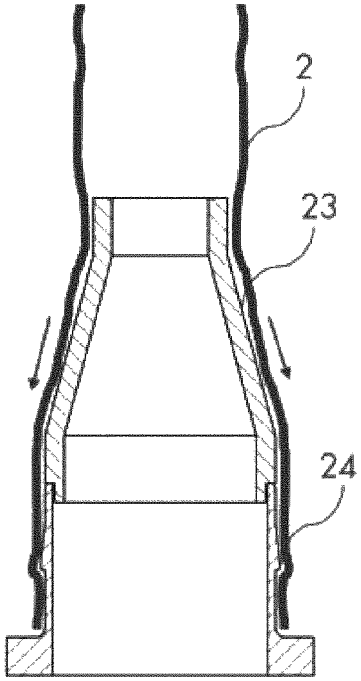
Figure 4B:
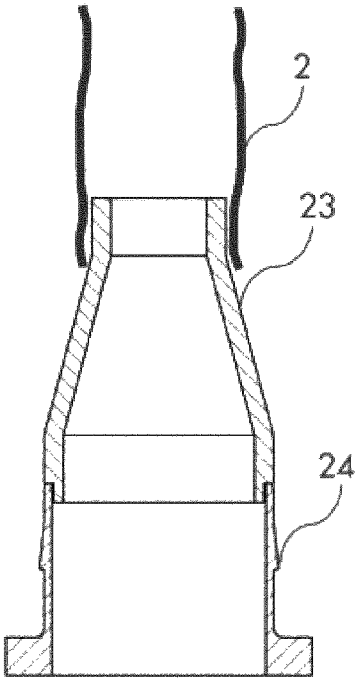
Figure 4A:
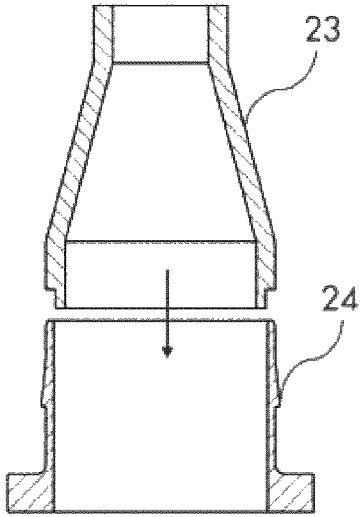
Figures 4E, 4F, 4G:
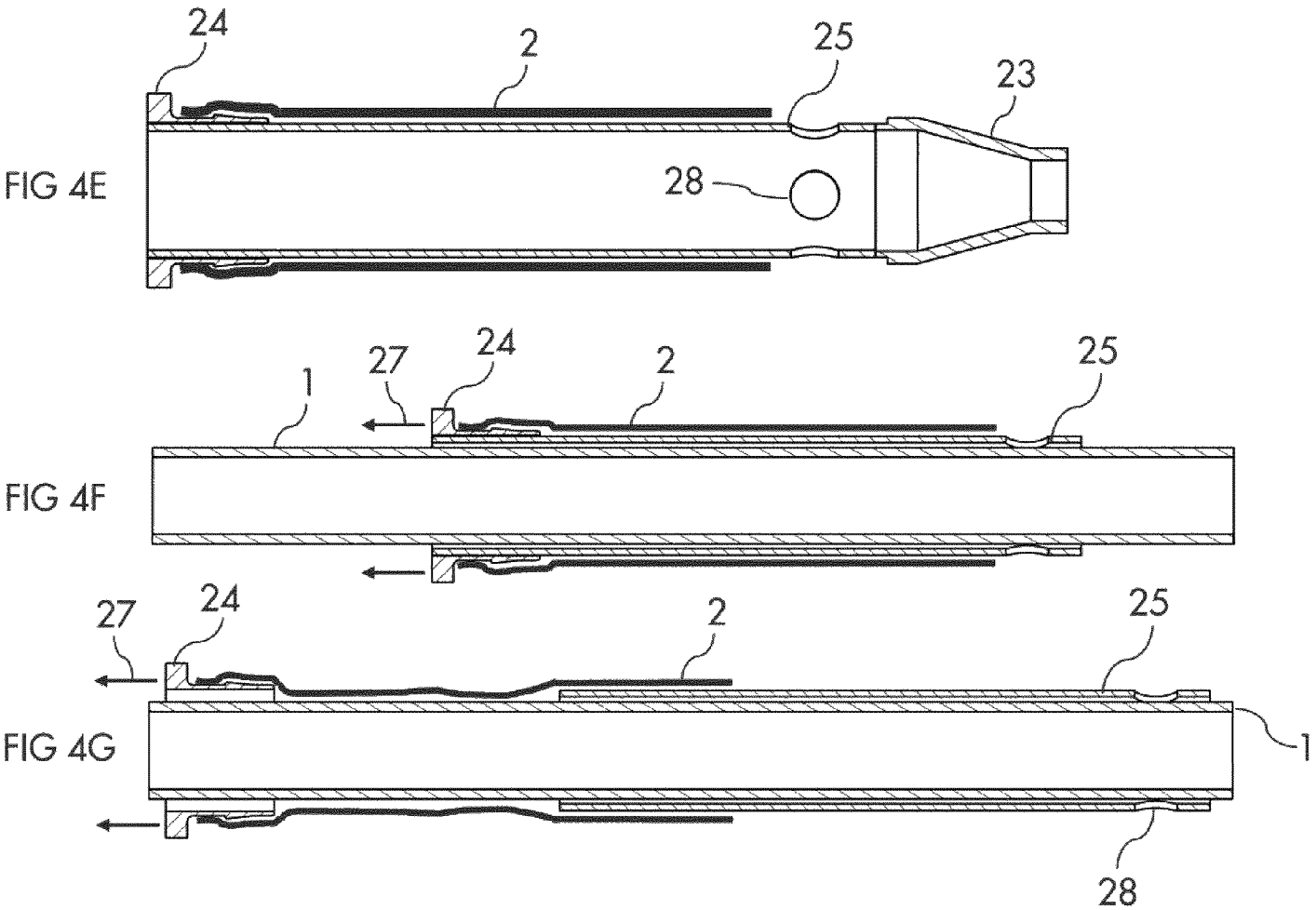
Figures 4H, 4I, 4J:
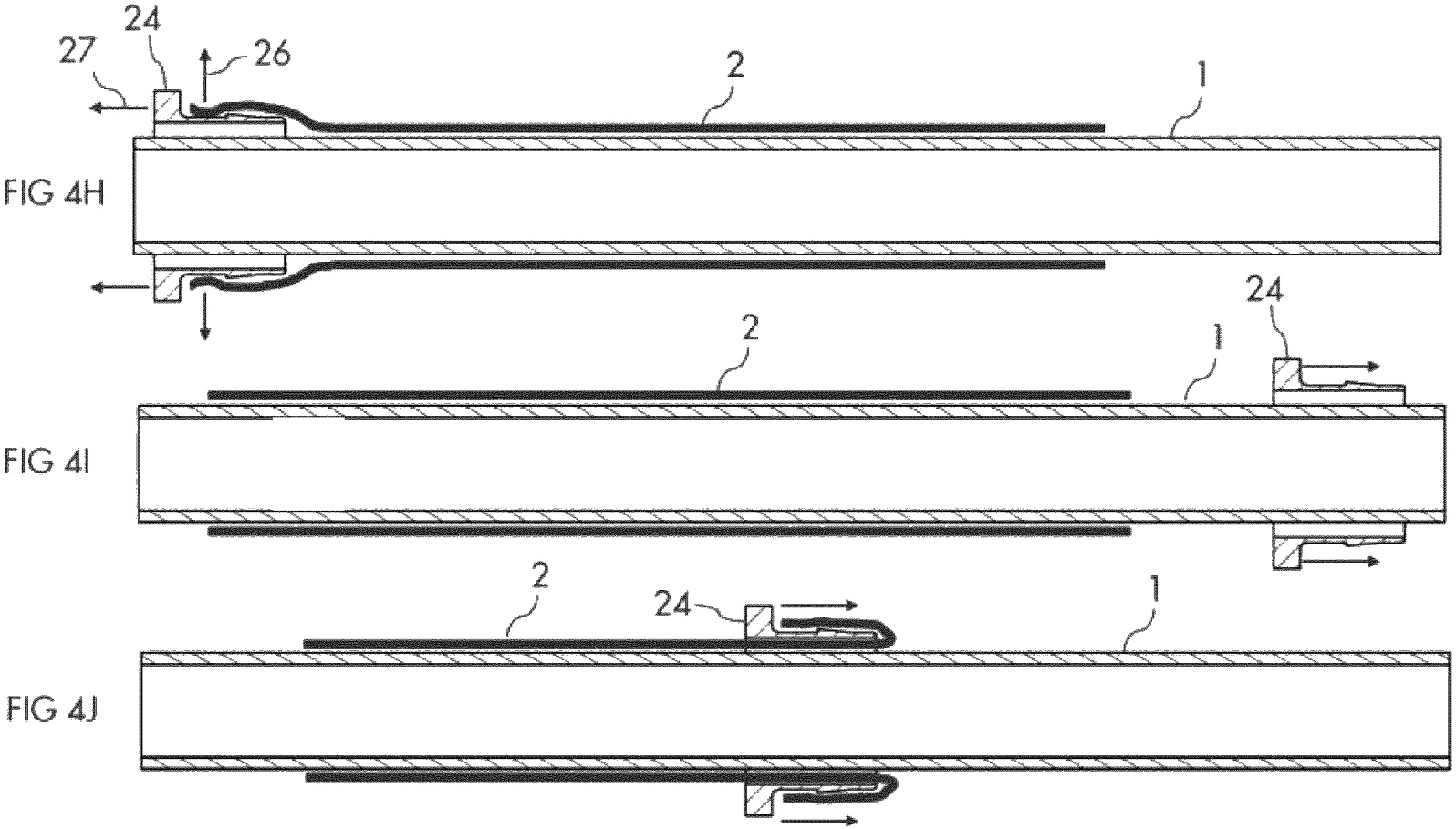

FIGS. 4A to 4J illustrate an alternative methodology to apply the elastomer sleeve to the wellbore tubular. The elastomer sleeve 2 can be placed over the wellbore tubular 1 by means of mechanically stretching the elastomer sleeve 2 by hand over tools as outlined in the figures. A mounting ring 24 is placed on a stable surface whereby a stretch cone 23 is placed on top as per FIG. 4A. The elastomer sleeve 2 is then placed over the stretch cone 23 as per FIG. 4B. A lubricant may be applied on the inner surface of the elastomer sleeve 2 and outer surface of the stretch cone 23 and outer surface of the mounting ring 24. The elastomer sleeve 2 is then pushed and stretched over the stretch cone 23 and mounting ring 24 as per FIG. 4C. The elastomer sleeve 2 is subsequently clamped onto mounting ring 24, suitably by means of a tie-wrap or hose clamp of some sort, at location 26 as per FIG. 4D. Then the mounting ring 24 is placed on top of a stretch tube 25 as per FIG. 4D. The stretch tube 25 has a larger inner diameter (ID) than a maximum outer diameter (OD) of a section of the wellbore tubular 1 where the elastomer sleeve 2 will be fitted. The mounting ring 24 is then pulled over the stretch tube 25, together with the attached elastomer sleeve 2. In this process the stretch cone 23 guides and stretches the elastomer sleeve 2 onto the stretch tube 25. The stretch cone 23 is removed when the elastomer sleeve 2 is fully stretched and pulled over stretch tube 25 as per FIG. 4E. The complete assembly with stretch tube 25, mounting ring 24 and elastomer sleeve 2 is then placed over the wellbore tubular 1 as per FIG. 4F. The elastomer sleeve 2 can now be pulled onto the wellbore tubular 1 by means of holding the stretch tube 25 in place at anchor points 28 (FIGS. 4E to 4G), and pulling on the mounting ring 24 in the direction of 27 shown in FIG. 4G. The stretch tube 25 can be removed from the wellbore tube when the elastomer sleeve 2 is completely pulled off the stretch tube 25. As shown in FIG. 4H, mounting ring 24 can now be removed by unclamping the sleeve at 26 and pulling in the direction of 27 away from the elastomer sleeve 2.

Subsequently the mounting ring 24 may be slid off the wellbore tubular 1 as per FIG. 4I, whereby the ID is of mounting ring 24 is larger than the elastomer sleeve 2 OD in stretch condition over wellbore tube 1. Alternatively, the elastomer sleeve 2 can be inverted by means of pushing the mounting ring 24 in the direction of the elastomer sleeve 2 prior unclamping at 26, as illustrated in FIG. 4J. This provides a possibility to remove the lubricant on the ID of the elastomer sleeve 2.

Figure 5:
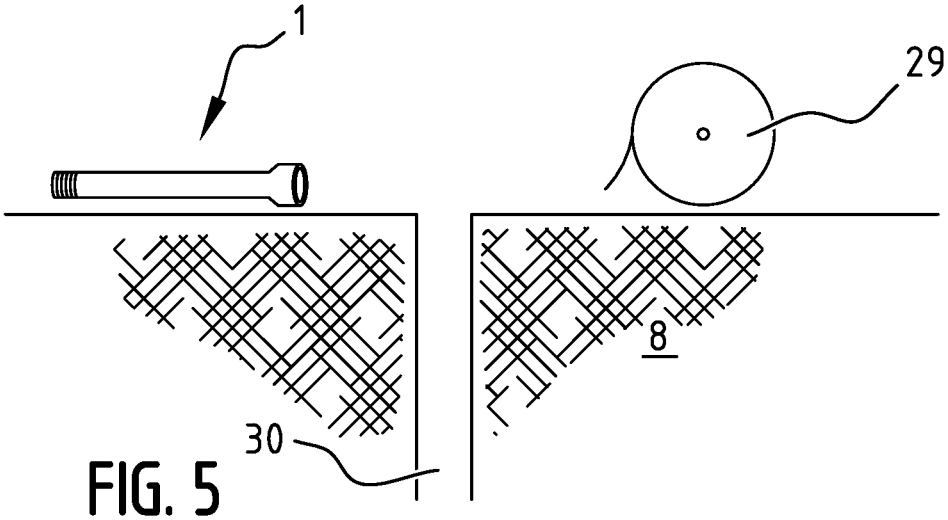
FIG. 5 schematically shows a well site.

The application of the elastomer sleeve 2 to the wellbore tubular 1 as described herein can be done in a workshop or at the wellsite, for example within a vicinity of up to several kilometers (or up to 1 km) from the wellbore 30 in which the wellbore tubular 1 will be deployed. As shown in FIG. 5, the elastomer sleeve may be transported from an elastomer production site to the wellsite on a reel 29. The length of the elastomer sleeve on the reel 29 may be multiple times the length of elastomer sleeves that will be fitted onto the wellbore tubular 1. The elastomer sleeve is suitably stored at the wellsite on the reel 29. Before fitting the elastomer sleeve 2 to the wellbore tubular 1, a suitable length of the elastomer sleeve 2 may be cut off from the long length available on the reel 29. This makes transport logistics cheaper.

The elastomer sleeve 2 is meant to supplement the sealing capability of the cement sheath 7. For this purpose, it does not have to have the capability to fill the entire annular space that surrounds the wellbore tubular 1 when configured into the wellbore. Therefore, the elastomer sleeve 2 can be quite thin, down to about 0.5 mm material thickness. Material thickness within a range of between 1 and 5 mm has been found suitable to compromise between sealing capacity and ease of handling (for example everting the ends over the outer tube as shown in FIG. 3C). The diameter of the elastomer sleeve can be tailored/selected relative to the diameter of the wellbore tubular. The length of the elastomer sleeve can be chosen freely, but in typical wellbore applications a length between 50 cm and 2 m would be suitable.

Figure 6:
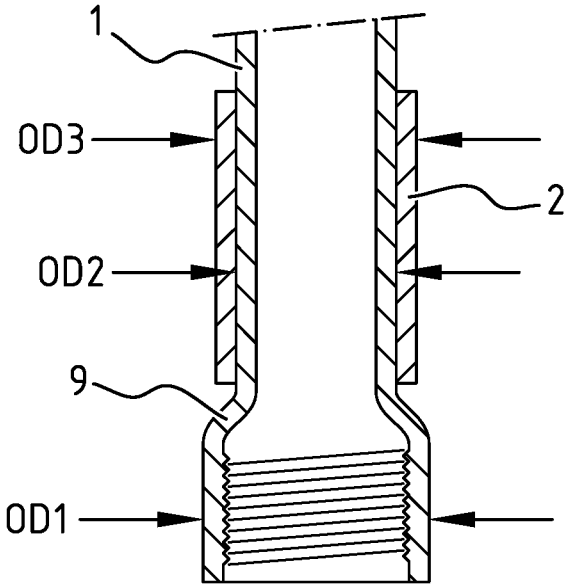
FIG. 6 schematically shows a cross sectional view of an elastomer sleeve snugly fit on a wellbore tubular near a connector.

As shown in FIG. 6, the wellbore tubular 1 may comprise a connector 9 provided on at least one end of the wellbore tubular 1. In the example as illustrated, the connector 9 is a threaded box for a pin/box connection. The connector 9 has having an outer diameter OD1 that is larger than an outer diameter OD2 of the wellbore tubular in a middle section of the wellbore tubular 1, where the elastomer sleeve 2 is snugly fitted. Suitably, the thickness of the elastomer sleeve 2, in when fitted onto the wellbore tubular middle section, has an outer diameter OD3 that is smaller than OD1 of the connector 9. This way the elastomer sleeve 2 is protected by the connector 9 during running into the wellbore. For the same reason, it is also advantageous to fit the elastomer sleeve 2 as close as possible to the connector 9.

It is anticipated that, due to the elasticity and/or swellability, a single layer of elastomer sleeve on the inner wellbore tube would suffice to combat microannuli on both sides of the cement sheath. However, if desired it is possible to apply a second layer of elastomer on the other side of the cement sheath by providing an elastomer clad layer on the material which defines the other side of the annulus around the wellbore tubular (i.e. the concave wall of the other side of the annulus). WO 2018/060117 A1, incorporated herein by reference, discloses a technology which can be applied to the pre-installed casing before running in the wellbore tubular of the present disclosure.

The person skilled in the art will understand that the present invention can be carried out in many various ways without departing from the scope of the appended claims.

We claim:

1. A method of installing a wellbore tubular in a wellbore in the Earth, comprising:

preparing a wellbore tubular comprising an elastomer sleeve;

lowering the wellbore tubular into a wellbore in the Earth at a wellsite; and pumping cement on the outside of the wellbore tubular whereby fully surrounding the elastomer sleeve;

wherein said preparing of the wellbore tubular comprises steps of:

providing the wellbore tubular;

providing an elastomer sleeve defining a circumference around a longitudinal bore in a longitudinal direction;

bringing the elastomer sleeve in an elastically stretched condition, by applying a stretching force to the elastomer sleeve, whereby elastically stretching the elastomer sleeve in a circumferential direction;

while the elastomer sleeve is kept in the elastically stretched condition, moving the elastomer sleeve in the longitudinal direction over the wellbore tubular, to a selected position on the wellbore tubular whereby the wellbore tubular extends through the bore; and subsequently:

snugly fitting the elastomer sleeve to an outside surface of the wellbore tubular by relaxing the elastically stretching force.

2. The method of claim 1, wherein residual elastic strain is still present in the elastomer sleeve when it is in snug contact with the wellbore tubular.

3. The method of claim 1, wherein the elastomer sleeve swells upon contact with water and/or brine.

4. The method of claim 1, wherein the elastomer sleeve swells upon contact with a hydrocarbon fluid.

5. The method of claim 1, further comprising applying a swell preventive coating layer on an outside surface of the elastomer sleeve subsequent to snugly fitting said elastomer sleeve to the wellbore tubular.

6. The method of claim 1, wherein the wellbore tubular comprises a connector provided on at least one end of the wellbore tubular and having an outer diameter that is larger than an outer diameter of the wellbore tubular in a middle section of the wellbore tubular where the elastomer sleeve is snugly fitted, and larger than an outer diameter of the elastomer sleeve as snugly fitted on the wellbore tubular middle section.

7. The method of claim 1, wherein the wellbore tubular is prepared at the wellsite.

8. The method of claim 1, wherein the elastomer sleeve is stored at the wellsite on a reel and wherein providing the elastomer sleeve comprises cutting off a length of the elastomer sleeve from the reel.

9. The method of claim 1, further comprising configuring a mechanical spacer on the wellbore tubular longitudinally adjacent to the elastomer sleeve, which extends further outward in radial direction from the longitudinal bore than the elastomer sleeve prior to any swelling.

10. The method of claim 9, further comprising applying a further elastomer sleeve using the method of claim 1.

* * * * *